US007665156B1

(12) United States Patent
Hewitt

(10) Patent No.: US 7,665,156 B1
(45) Date of Patent: Feb. 23, 2010

(54) HYDRATION AND MOTORCYCLE PROTECTION COMBINATION SYSTEM

(76) Inventor: Paul B. Hewitt, 60 Obsidian Dr., Oakdale, CA (US) 95361

( * ) Notice: Subject to any disclaimer, the term of this patent is extended or adjusted under 35 U.S.C. 154(b) by 574 days.

(21) Appl. No.: 11/318,010

(22) Filed: Dec. 27, 2005

(51) Int. Cl.
*A41D 27/00* (2006.01)

(52) U.S. Cl. ..... 2/462; 2/455; 224/148.1; 224/148.2

(58) Field of Classification Search ..... 2/462, 2/455, 458, 102; 224/148.2, 148.3, 637; 222/175
See application file for complete search history.

(56) References Cited

U.S. PATENT DOCUMENTS

| | | | | |
|---|---|---|---|---|
| D245,731 | S | 9/1977 | Bargsten | |
| 4,544,087 | A * | 10/1985 | Modig | 224/148.2 |
| 4,580,408 | A | 4/1986 | Stuebner | |
| 5,060,833 | A | 10/1991 | Edison et al. | |
| 5,465,885 | A * | 11/1995 | Wyatt | 224/148.2 |
| 5,864,880 | A | 2/1999 | Adam | |
| 5,957,348 | A * | 9/1999 | Foreman | 224/148.1 |
| 6,220,490 | B1 * | 4/2001 | O'Hara | 224/148.2 |
| 6,497,348 | B2 * | 12/2002 | Forsman et al. | 224/148.2 |
| 2002/0124294 | A1 * | 9/2002 | McKenzie et al. | 2/69 |
| 2004/0210992 | A1 * | 10/2004 | Morrow et al. | 2/455 |
| 2004/0244100 | A1 | 12/2004 | Haddacks | |
| 2006/0113336 | A1 * | 6/2006 | Spencer | 224/148.2 |
| 2008/0179356 | A1 * | 7/2008 | Edy et al. | 224/148.2 |

* cited by examiner

*Primary Examiner*—Gary L Welch
*Assistant Examiner*—Alissa J Tompkins

(57) ABSTRACT

A hydration and motorcycle protection combination system for providing impact protection for a motorcycle rider and a liquid to be drank and keep the motorcycle rider hydrated includes a breast plate and a back plate positioned over a portion of a torso of a person to inhibit damage to a chest and back of the person when the breast plate and back plate are impacted. Each of a plurality of torso straps is coupled between the breast plate and the back plate to press the breast plate and the back plate against the torso to secure the back plate and the breast plate to the torso. A hydration assembly is coupled to the back plate. The hydration assembly contains a consumable liquid to be drunk by the person to keep the person hydrated.

10 Claims, 4 Drawing Sheets

HYDRATION AND MOTORCYCLE PROTECTION COMBINATION SYSTEM

BACKGROUND OF THE INVENTION

1. Field of the Invention

The present invention relates to protective vests and more particularly pertains to a new protective vest for providing impact protection for a motorcycle rider and for providing a liquid to be drank to keep the motorcycle rider hydrated.

2. Description of the Prior Art

The use of protective vests is known in the prior art. U.S. Pat. No. 6,580,408 describes a device for permitting air to pass through a layer saturated with water to cool the air passing therethrough and thereby cooling the air and cooling a wearer as the cooled air passes over the wearer. Another type of protective vest is U.S. Patent Application No. 2004/0244100 for providing a protective vest that deploys an air bag from in front of a wearer to protect the wearer. Another type of protective vest is U.S. Pat. No. 6,220,490 for providing a container for liquid in the shape of a vest to be worn by a person and allow the person to drink the liquid from the container.

While these devices fulfill their respective, particular objectives and requirements, the need remains for a system that has certain improved features that provide impact protection for a portion of the torso and arms of a person and carries a supply of liquid to be consumed by the person to keep the person hydrated.

SUMMARY OF THE INVENTION

The present invention meets the needs presented above by generally comprising a breastplate being positioned over a front of a torso of a person to inhibit damage to a chest of a person when the breast plate is impacted. A back plate is positioned over a back of the torso of the person to inhibit damage to a back of the person when the back plate is impacted. Each of a plurality of torso straps is coupled between the breast plate and the back plate to press the breast plate and the back plate against the torso to secure the back plate and the breast plate to the torso. A hydration assembly is coupled to the back plate. The hydration assembly contains a consumable liquid to be drunk by the person to keep the person hydrated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
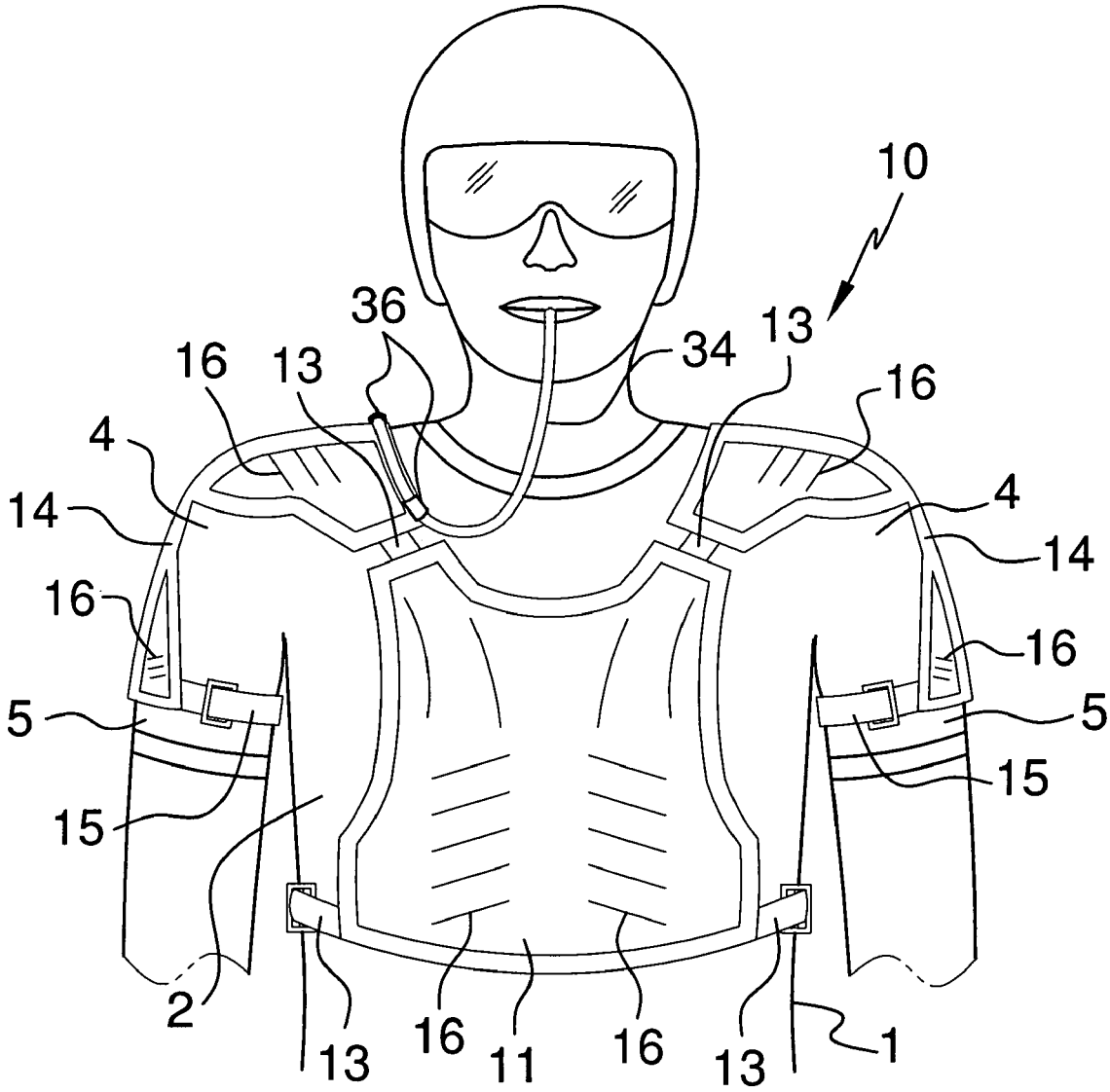
FIG. 1 is a front view of a hydration and motorcycle protection combination system according to the present invention shown in use.
Figure 2:
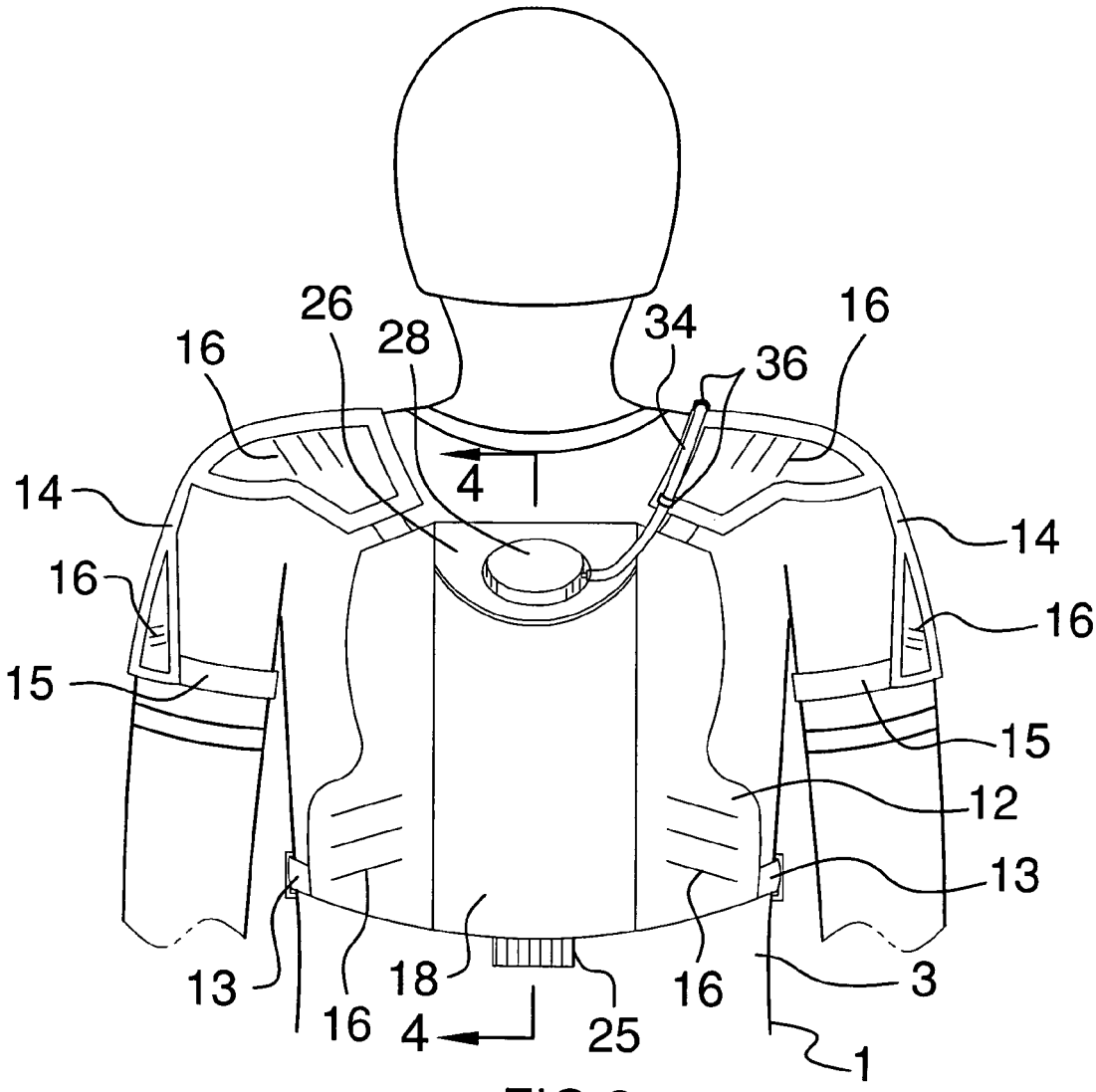
FIG. 2 is a rear view of the present invention.
Figure 3:
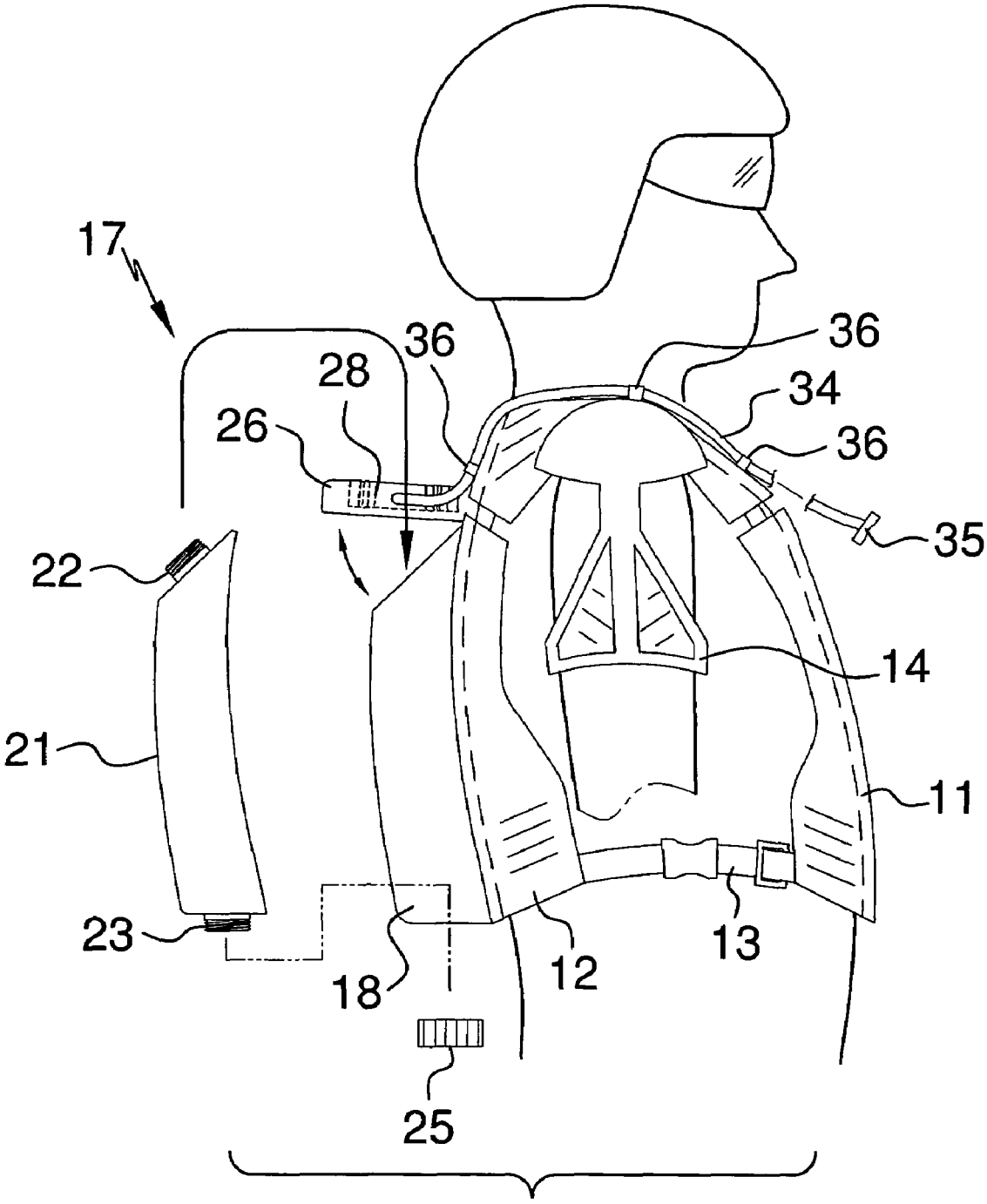
FIG. 3 is an exploded side view of the present invention.
Figure 4:
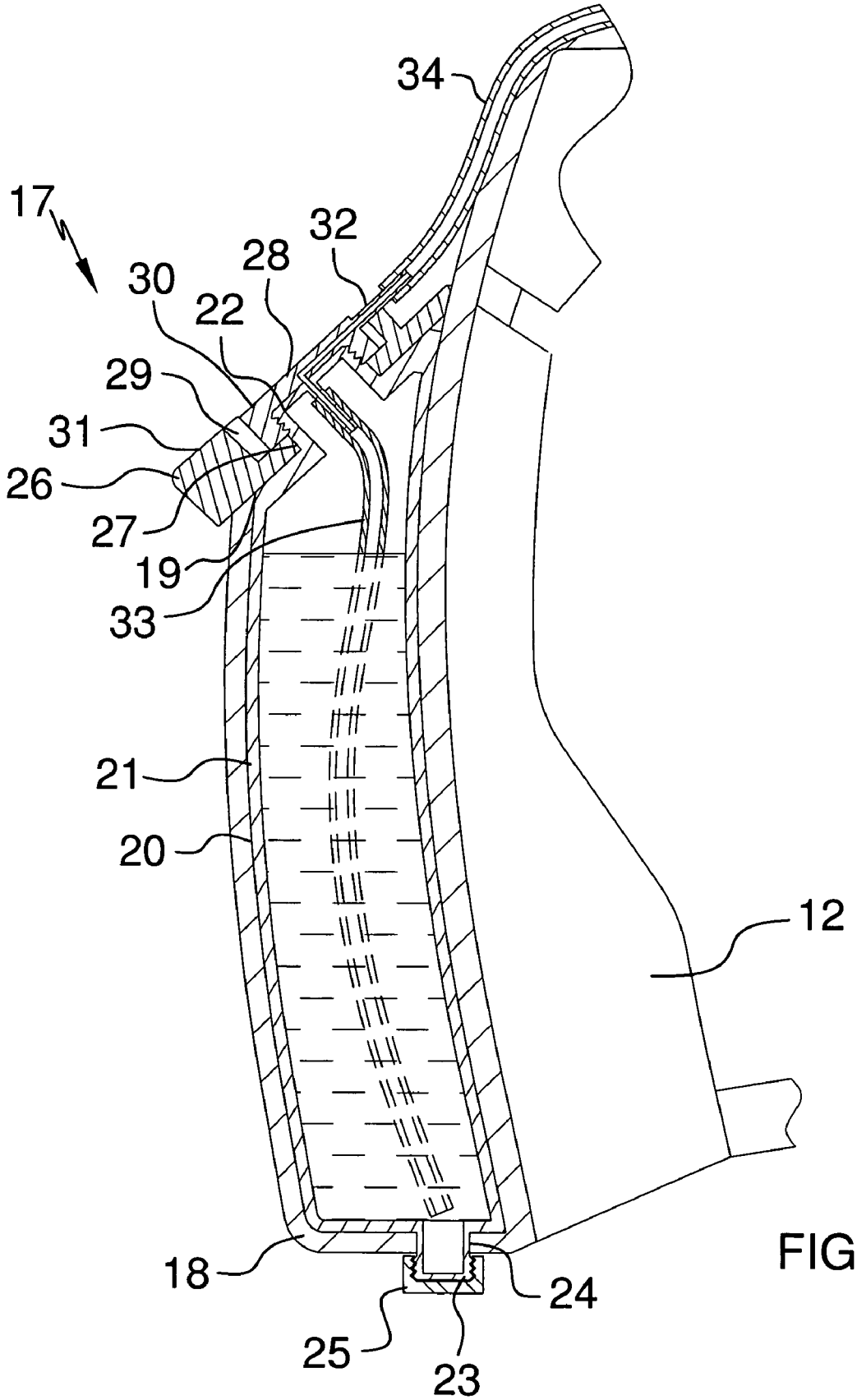
FIG. 4 is a cross-sectional view of the present invention taken along line 4-4 of FIG. 2.

With reference now to the drawings, and in particular to FIGS. 1 through 4 thereof, a new protective vest embodying the principles and concepts of the present invention and generally designated by the reference numeral 10 will be described.

As best illustrated in FIGS. 1 through 4, the hydration and motorcycle protection combination system 10 generally comprises a breast plate 11 being positioned over a front of a torso 1 of the person to inhibit damage to a chest 2 of the person when the breast plate 11 is impacted. A back plate 12 is positioned over a back of the torso 1 of the person to inhibit damage to a back 3 of the person when the back plate 12 is impacted. Each of a plurality of torso straps 13 is coupled between the breast plate 11 and the back plate 12 to press the breast plate 11 and the back plate 12 against the torso 1 to secure the back plate 12 and the breast plate 11 to the torso 1. A length of at least a pair of the torso straps 13 is adjustable to permit adjustment of a distance between the breast plate 11 and the back plate 12.

Each of a pair of pauldrons 14 is positioned over shoulders 4 and a portion of upper arms 5 of the person to inhibit damage to the shoulders 4 and upper arms 5 of the person when the pauldrons 14 are impacted. Each of the pauldrons 14 is mounted to one of the torso straps 13 extending over the clavicle to maintain positioning of the pauldrons 14. Each of a plurality of arm straps 15 is coupled to one the pauldrons 14 and extends around the upper arm of the person to maintain positioning of the pauldrons 14 with respect to the shoulder and upper arm of the user. A length of each of the arm straps 15 is adjustable to accommodate a girth of the upper arm of the person. Each of a plurality of vents 16 extends through the back plate 12, the breast plate 11 or one of the pauldrons 14. Each of the vents 16 permits the air to flow through the back plate 12, the breast plate 11 or the pauldrons 14 to cool the person wearing the back plate 12, breast plate 11 and the pauldrons 14.

A hydration assembly 17 is coupled to the back plate 12. The hydration assembly 17 contains a consumable liquid 6 to be drunk by the person to keep the person hydrated. The hydration assembly 17 includes a pouch 18 coupled to the back plate 12 and extends outwardly from the back plate 12. The pouch 18 has an open upper end 19 to allow access to an interior space 20 of the pouch 18.

The hydration assembly 17 also includes a container 21 insertable into the interior space 20 of the pouch 18 to permit the container 21 to be carried on the back 3 of the person. The container 21 is configured to receive the consumable liquid 6. An access port 22 is in fluid communication with the container 21 and extends upwardly from the container 21 to permit the consumable liquid 6 to be poured into the container 21. A drain port 23 is fluidly coupled to the container 21 and extends downwardly from the container 21 to permit consumable liquid 6 in the container 21 to be drained from the container 21. The drain port 23 extends through a drain aperture 24 in the pouch 18 when the container 21 is in the pouch 18. A drain cap 25 selectively engages the drain port 23 of the container 21 to close the drain port 23 and inhibit the consumable liquid 6 pouring from the container 21.

Additionally, the hydration assembly 17 includes a lid 26 positioned over the open upper end 19 of the pouch 18 to maintain the container 21 in the pouch 18. The lid 26 has a port aperture 27 extending therethrough to permit the access port 22 of the container 21 to pass through the lid 26. An access cap 28 is selectively secured to the access port 22 of the container 21 to inhibit spilling of the consumable liquid 6 from the container 21. The access cap 28 is positioned in a depression 29 of the lid 26 that is positioned around the port aperture 27 to permit a top surface 30 of the access cap 28 to be aligned with an upper surface 31 of the lid 26. A transfer pipe 32 extends through the access cap 28 and is in fluid communication with the container 21. Additionally, a supply tube 33 may be coupled to the transfer pipe 32 and extends into the container 21 to provide additional access to the liquid 6 in the container 21.

A drinking tube 34 is coupled to the transfer pipe 32 opposite the container 21. A free end 35 of the drinking tube 34 is engaged by a mouth of the person to permit the person to suck the consumable fluid from the container 21. Each of a plurality of clips 36 is coupled to one of the pauldrons 14 and engages the drinking tube 34 to secure the drinking tube 34 to the pauldron 14. The clips 36 maintain a position of the drinking tube 34 to allow the drinking tube 34 to be readily located by the person when the person wishes to drink the liquid 6.

In use, the container 21 is filled with the liquid 6 and inserted into the pouch 18 on the back plate 12. The lid 26 is the placed over the open upper end 19 of the pouch 18 and the access cap 28 is secured to the access port 22 of the container 21. The back plate 12 and the breast plate 11 are secured around the torso 1 of the person and the arm straps 15 are secured around the upper arms 5 of the person to maintain positioning of the pauldrons 14. The user then places the free end 35 of the drinking tube 34 into the mouth and sucks the liquid 6 from the container 21 through the drinking tube 34 to drink the liquid 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hydration and motorcycle protection combination system for hydrating a person riding a motorcycle, the system comprising:

a breast plate being positioned over a front of a torso of the person to inhibit damage to a chest of the person when said breast plate is impacted;

a single back plate being positioned over a back of the torso of the person to inhibit damage to a back of the person when said back plate is impacted;

a plurality of torso straps, each of said torso straps being coupled between said breast plate and said back plate to press said breast plate and said back plate against the torso to secure said back plate and said breast plate to the torso, a length of at least a pair of said torso straps being adjustable to permit adjustment of a distance between said breast plate and said back plate; and a hydration assembly being coupled to said back plate, said hydration assembly containing a consumable liquid to be drunk by the person to keep the person hydrated, said hydration assembly including;

a pouch being non-removably coupled to said back plate and extending outwardly from said back plate, said pouch having an open upper end to allow access to an interior space of said pouch;

a container being insertable into said interior space of said pouch to permit said container to be carried on the back of the person, said container being configured to receive the consumable liquid; and a lid being positioned over said open upper end of said pouch to maintain said container in said pouch, said lid having a port aperture extending therethrough to permit an access port in fluid communication with said container to pass through said lid.

2. The system according to claim 1, further comprising a pair of pauldrons being positioned over shoulders and a portion of upper arms of the person to inhibit damage to the shoulders and upper arms of the person when said pauldrons are impacted, each of said pauldrons being mounted to one of said torso straps extending over the clavicle to maintain positioning of said pauldrons.

3. The system according to claim 2, further comprising a plurality of arm straps, each of said arm straps being coupled to one said pauldrons and extending around the upper arm of the person to maintain positioning of said pauldron with respect to the shoulder and upper arm of the user, a length of each of said arm straps being adjustable to accommodate a girth of the upper arm of the person.

4. The system according to claim 1, wherein said container further includes a drain port being fluidly coupled to said container and extending downwardly from said container to permit consumable liquid in said container to be drained from said container.

5. The system according to claim 4, wherein said drain port extends through a drain aperture in said pouch when said container is in said pouch.

6. The system according to claim 4, wherein said hydration assembly includes a drain cap selectively engaging said drain port of said container to close said drain port and inhibit the consumable liquid pouring from said container.

7. The system according to claim 1, wherein said hydration assembly includes an access cap being selectively secured to said access port of said container to inhibit spilling of the consumable liquid from said container.

8. The system according to claim 7, wherein said hydration assembly includes a transfer pipe extending through said access cap and being in fluid communication with said container.

9. The system according to claim 8, wherein said hydration assembly includes a drinking tube being coupled to said transfer pipe opposite said container, said drinking tube being engaged by a mouth of the person to permit the person to suck the consumable fluid from said container.

10. A hydration and motorcycle protection combination system for hydrating a person riding a motorcycle, the system comprising:

a breast plate being positioned over a front of a torso of the person to inhibit damage to a chest of the person when said breast plate is impacted;

a single back plate being positioned over a back of the torso of the person to inhibit damage to a back of the person when said back plate is impacted;

a plurality of torso straps, each of said torso straps being coupled between said breast plate and said back plate to press said breast plate and said back plate against the torso to secure said back plate and said breast plate to the torso, a length of at least a pair of said torso straps being adjustable to permit adjustment of a distance between said breast plate and said back plate;

a pair of pauldrons being positioned over shoulders and a portion of upper arms of the person to inhibit damage to the shoulders and upper arms of the person when said pauldrons are impacted, each of said pauldrons being mounted to one of said torso straps extending over the clavicle to maintain positioning of said pauldrons;

a plurality of arm straps, each of said arm straps being coupled to one said pauldrons and extending around the upper arm of the person to maintain positioning of said pauldron with respect to the shoulder and upper arm of the user, a length of each of said arm straps being adjustable to accommodate a girth of the upper arm of the person;

a hydration assembly being coupled to said back plate, said hydration assembly containing a consumable liquid to be drunk by the person to keep the person hydrated, said hydration assembly comprising;

a pouch being non-removably coupled to said back plate and extending outwardly from said back plate, said pouch having an open upper end to allow access to an interior space of said pouch;

a container being insertable into said interior space of said pouch to permit said container to be carried on the back of the person, said container being configured to receive the consumable liquid, an access port being in fluid communication with said container and extending upwardly from said container to permit the consumable liquid to be poured into said container, a drain port being fluidly coupled to said container and extending downwardly from said container to permit consumable liquid in said container to be drained from said container, said drain port extending through a drain aperture in said pouch when said container is in said pouch;

a lid being positioned over said open upper end of said pouch to maintain said container in said pouch, said lid having a port aperture extending therethrough to permit said access port of said container to pass through said lid;

an access cap being selectively secured to said access port of said container to inhibit spilling of the consumable liquid from said container;

a transfer pipe extending through said access cap and being in fluid communication with said container;

a drinking tube being coupled to said transfer pipe opposite said container, said drinking tube being engaged by a mouth of the person to permit the person to suck the consumable fluid from said container; and a drain cap selectively engaging said drain port of said container to close said drain port and inhibit the consumable liquid pouring from said container.

* * * * *